US006935863B2

(12) United States Patent
Frigon

(10) Patent No.: US 6,935,863 B2
(45) Date of Patent: Aug. 30, 2005

(54) TRAINING DEVICE AND METHOD FOR TRAINING A SHOOTER TO SHOOT WITH IMPROVED ACCURACY

(76) Inventor: Fay F. Frigon, 106 E. Ridgewood Dr., Garland, TX (US) 75041

( * ) Notice: Subject to any disclaimer, the term of this patent is extended or adjusted under 35 U.S.C. 154(b) by 340 days.

(21) Appl. No.: 10/178,674

(22) Filed: Jun. 24, 2002

(65) Prior Publication Data

US 2003/0003425 A1 Jan. 2, 2003

Related U.S. Application Data

(60) Provisional application No. 60/301,397, filed on Jun. 27, 2001.

(51) Int. Cl.[7] ..... F41G 3/26
(52) U.S. Cl. ..... 434/19; 434/16
(58) Field of Search ..... 434/19, 23, 16, 434/17, 11, 21, 22, 247, 258

(56) References Cited

U.S. PATENT DOCUMENTS 2,319,787 A * 5/1943 Black ..... 434/19
2,510,413 A * 6/1950 Paige ..... 434/19
4,245,402 A * 1/1981 Lanese ..... 434/19
4,279,601 A * 7/1981 Cobelli ..... 434/247
4,708,341 A * 11/1987 Paraskevakos ..... 482/120
4,783,070 A * 11/1988 Bauer et al. ..... 473/453
5,431,409 A * 7/1995 Webster ..... 273/369
5,476,385 A * 12/1995 Parikh et al. ..... 434/22
5,846,083 A * 12/1998 Alexander ..... 434/19
6,068,483 A * 5/2000 Minor ..... 434/19
H1891 H * 10/2000 McClenahan et al. ..... 434/19
6,406,298 B1 * 6/2002 Varshneya et al. ..... 434/21
6,425,765 B1 * 7/2002 Irwin, III ..... 434/247

* cited by examiner

*Primary Examiner*—Kurt Femstrom
(74) *Attorney, Agent, or Firm*—Steven W. Smith

(57) ABSTRACT

A device and method for training a shooter to shoot with improved accuracy. A picture of a target is fixedly mounted in front of a sight on a bow or gun. The picture is mounted in a stationary position which visually aligns an aiming point in the sight with the center of the picture when the shooter is in a shooting position. The shooter then shoots a plurality of shots in a safe direction while looking through the sight and focusing on the stationary mounted picture. In this manner, the shooter's subconscious mind is trained to keep the sight aligned with an actual target while shooting.

10 Claims, 4 Drawing Sheets

TRAINING DEVICE AND METHOD FOR TRAINING A SHOOTER TO SHOOT WITH IMPROVED ACCURACY

PRIORITY STATEMENT UNDER 35 U.S.C. §119 (e) & 37 C.F.R. §1.78

This nonprovisional application claims priority based upon the prior U.S. provisional patent application entitled, "Training Device and Method for Archery and Gunnery," application No. 60/301,397, filed Jun. 27, 2001 in the name of Fay F. Frigon.

BACKGROUND OF THE INVENTION

1. Technical Field of the Invention

This invention relates to archery and gunnery training devices. More particularly, and not by way of limitation, the present invention is directed to a training device and method for training an archer or gunner to shoot with improved accuracy.

2. Description of Related Art

Over the years, many advances have been made in the sport of archery to improve accuracy. Improvements in bow design, the addition of sights, and the use of release mechanisms to release the bow string have all contributed to greater accuracy. For example, the bow has evolved from the long bow to the compound bow. The compound bow uses a cam to increase arrow speed and improve accuracy. Sights and/or scopes are mounted on bows, and may have a plurality of sight pins that are adjustable for different target distances. Release mechanisms assist the archer by enabling the archer to release the bow string with a trigger device. Releasing a bow string with fingers increases string oscillation, thereby reducing accuracy. Release mechanisms reduce string oscillation, with a resultant increase in accuracy.

Despite the technical improvements in archery equipment described above, accuracy is still limited by the human operator. One limitation is known as "target panic". All shooters (archers and gunners) experience target panic to some degree. This is a condition at the moment of shooting a bow or firing a gun when, having made the decision to release the bow string or press the trigger, the shooter's mind freezes and no longer makes corrections if the sight drifts off the target. For example, with a fully drawn bow, if the pin in the sight drifts off the target, the archer's mind does not recognize the error, and no correction is made.

Target panic is an unconscious condition which often goes undiagnosed as the source of a shooter's accuracy problem because the shooter is not aware that it is happening. It is thought that target panic occurs because the mind is overloaded, and cannot simultaneously perform another task. In archery, for example, archers are simultaneously performing the tasks of holding back the bow string, making corrections to hold the bow vertical, judging the wind, judging the distance to the target, selecting a sight pin appropriate for the distance, and moving the bow to optically align the selected sight pin with the target. Competition archers use from 9 to 15 steps to complete a shot. When the additional mental task of deciding to shoot is added, or if a thought enters the mind raising a fear about the accuracy of the coming shot, the mind overloads and stops making corrections. This causes the archer to squeeze the release mechanism when the sight pin is not aligned with the target.

An existing method of overcoming target panic is to train a shooter to squeeze the release mechanism or trigger so slowly that the shooter himself is surprised when the weapon fires. The reasoning is that the shooter's mind will continue to make corrections up until the moment of shooting since a mental decision to fire is never made. However, this technique presumes that the shooter's mind is not already overloaded from other tasks, and that it is the decision to shoot that causes the overload and the target panic. This may not be the case. In addition, this technique has several other disadvantages. First, being uncertain when the weapon is going to fire may be uncomfortable for many shooters. Second, since an archer must maintain considerable force to hold back the bow string, his shot may get less accurate if this position must be held for a longer period of time. The same is true for a gunner if he is shooting a fairly heavy rifle or pistol. Third, archers and gunners engaged in shooting competitions may have to shoot rapidly, and it is not realistic to squeeze the release mechanism or trigger so slowly that the shooter is surprised when the weapon fires.

Thus, in order to overcome the disadvantage of existing solutions, it would be advantageous to have a training device and method for training an archer or gunner to overcome the mental problem of target panic that effectively eliminates the problem of target panic regardless of other tasks being performed. The present invention provides such a device and method.

SUMMARY OF THE INVENTION

In one aspect, the present invention is directed to a training device for training a shooter to shoot with improved accuracy. The device includes a picture of a target, and means for mounting the picture on an opposite side of a sighting mechanism from the shooter's eye. The picture is mounted in a position in which the picture is visually aligned with the sighting mechanism when the shooter is in a shooting position. By shooting shots while looking through the sighting mechanism and focusing on the stationary picture, the shooter's subconscious mind is trained to maintain a sight-picture in which the sighting mechanism remains aligned with the target while shooting.

In another aspect, the present invention is directed to a method of training a shooter to shoot with improved accuracy. The method begins by fixedly mounting a picture of a target on an opposite side of a sighting mechanism from the shooter's eye, the picture being mounted in a stationary position in which the center of the picture is visually aligned with the sighting mechanism when the shooter is in a shooting position. This is followed by shooting a plurality of shots by the shooter while looking through the sighting mechanism and focusing on the stationary picture of the target. In this manner, the shooter's subconscious mind is trained to maintain a sight-picture in which the sighting mechanism remains aligned with the target while shooting.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

The present invention is directed to a training device and method for training an archer or gunner to overcome the mental problem of "target panic" at the moment of shooting. During shooting practice, the invention trains the shooter's subconscious mind to hold the sight on the center of the target until the shot is completed. Thereafter, when the shooter shoots at a real target, target panic is overcome, and accuracy is improved.

Figure 1:
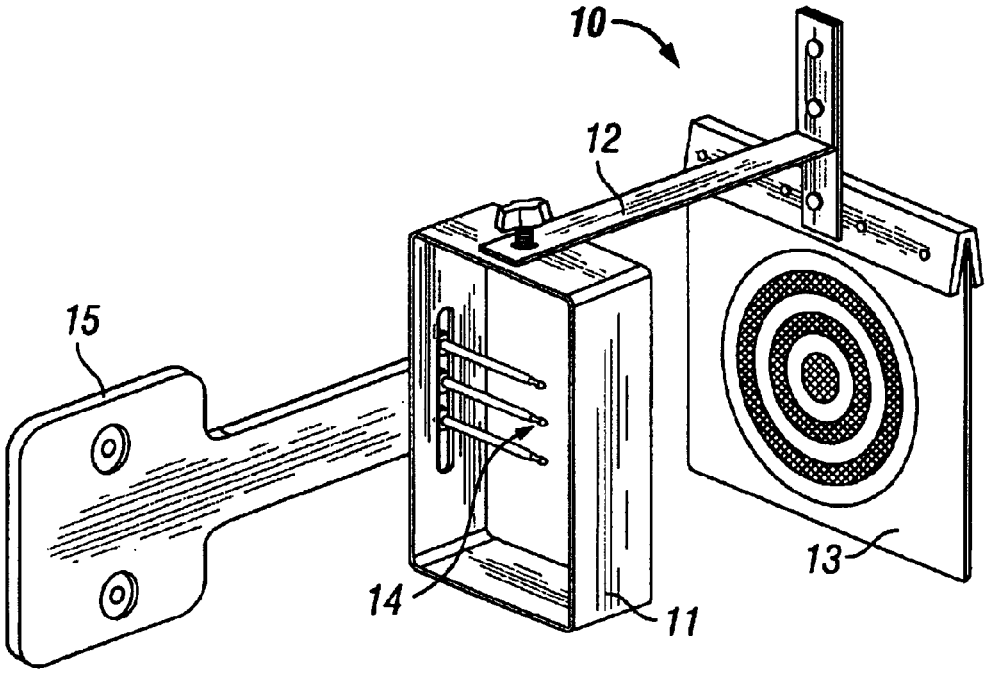
FIG. 1 is a perspective view of a first embodiment of the training device of the present invention mounted on an archery pin sight.

FIG. 1 is a perspective view of a first embodiment of the training device 10 of the present invention mounted on an archery pin sight 11 with, for example, a mounting bracket 12. A picture 13 (for example, a drawing or photograph) of a target is mounted in a position in which the pin sight is visually aligned with the picture. The picture may be mounted by any suitable means such as, for example, hook-and-pile material (i.e., Velcro), clamps, screws, tape, adhesive, and the like. The mounting bracket allows the position of the picture to be adjusted horizontally and vertically so that the center of the target is visually aligned with a selected pin 14. The pin sight 11 mounts to a bow (not shown) with a pin sight mounting bracket 15. The entire apparatus (pin sight 11 and mounted training device 10) is thus held in a stationary position on the bow.

The picture 13 is stationary relative to the pin sight 11, and thus the sight cannot drift off of the pictured target. The shooter then practices shooting in a safe direction while "aiming" at the pictured target. This process trains the subconscious mind to maintain the image that the shooter sees (i.e., the sight pin 14 aligned with the target and not moving). Thereafter, when shooting at an actual target, the mind is conditioned, and the mind will not allow the sight to drift off the actual target when shooting.

Figure 2:
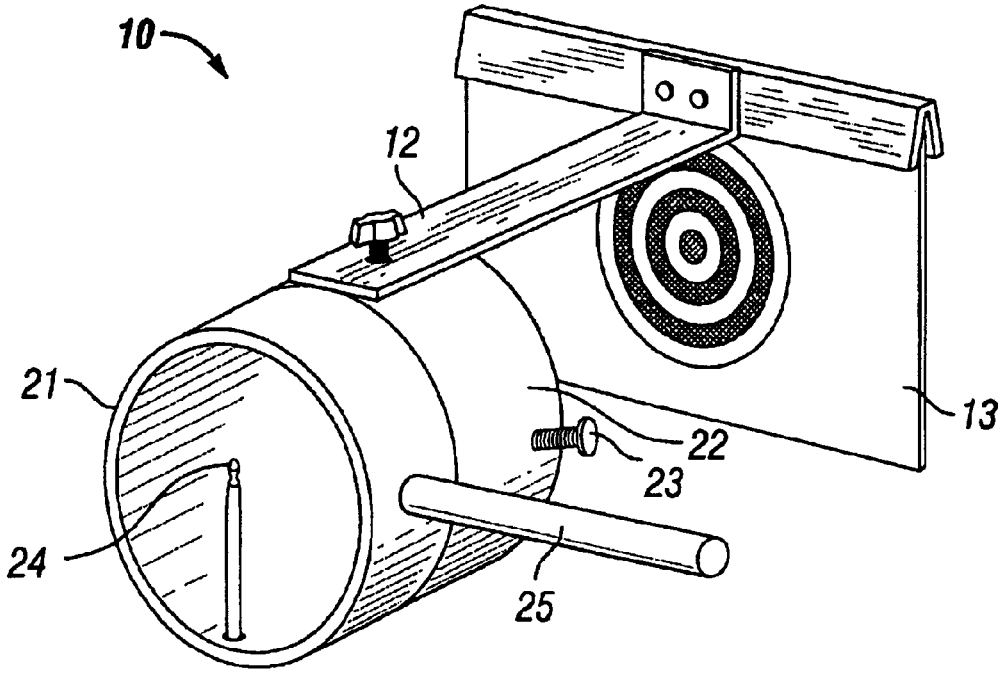
FIG. 2 is a perspective view of a second embodiment of the training device of the present invention mounted on an archery scope sight.

FIG. 2 is a perspective view of a second embodiment of the training device 10 of the present invention mounted on an archery scope sight 21. The configuration of the scope sight 21 is different from the pin sight 11 (FIG. 1), thereby requiring a mounting ring 22 for mounting the training device to the scope sight. A set screw 23 or other suitable mechanism such as Velcro, clamps, tape, or adhesive may be utilized to secure the mounting ring to the scope sight.

The operation of the training device in this embodiment is substantially unchanged from the first embodiment. The scope sight uses an aiming point 24 in the center of the scope field of view. The picture 13 of the target is therefore mounted in a position in which the aiming point 24 is visually aligned with the center of the target. The scope sight mounts to a bow (not shown) with a scope sight mounting bracket 25. The entire apparatus (pin sight 11 and mounted training device 10) is thus held in a stationary position on the bow. Once again, the picture 13 is stationary relative to the scope sight 21, and thus the sight cannot drift off of the pictured target. The shooter then practices shooting in a safe direction while "aiming" at the pictured target. Again, the subconscious mind is trained to maintain this image while shooting at actual targets.

Figure 3:
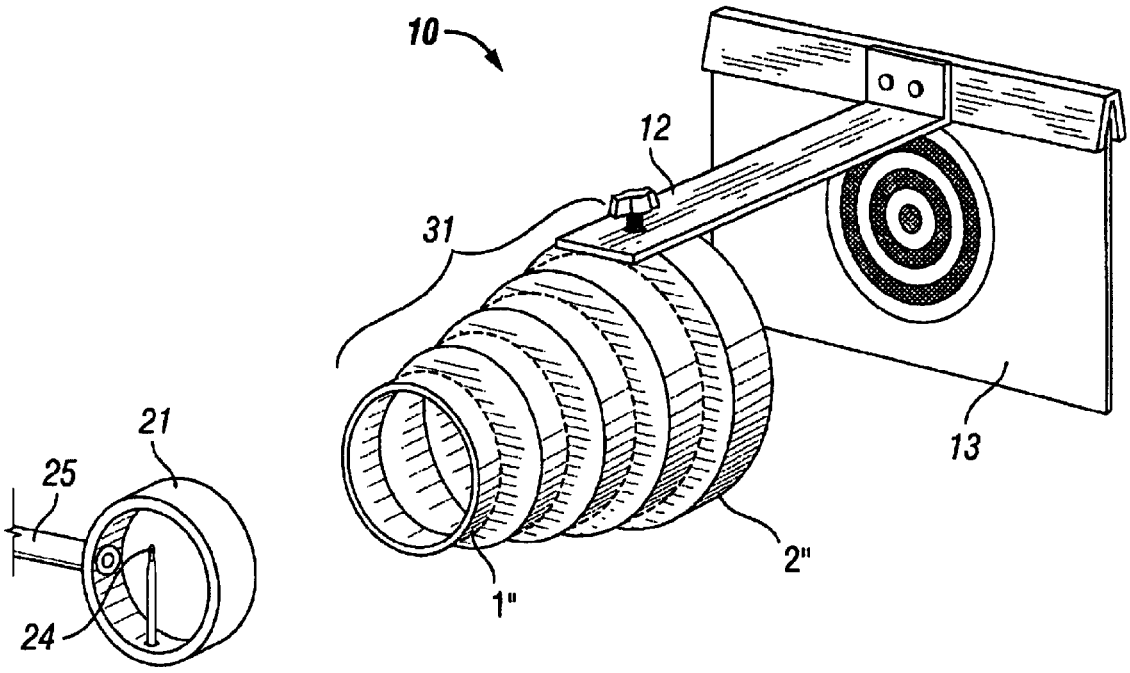
FIG. 3 is a perspective view of an alternative embodiment of the training device illustrated in FIG. 2.

FIG. 3 is a perspective view of an alternative embodiment of the training device 10 illustrated in FIG. 2. In this embodiment, the training device includes a plurality of cut-off mounting rings 31 of varying diameters. For example, the rings may range from one inch to two inches in diameter. Scope sights are manufactured in varying diameters, and the diameters of the cut-off mounting rings may be sized to match the most common scope diameters. In use, therefore, the shooter selects the size that matches his scope, and cuts off the smaller sized mounting rings. The selected mounting ring is then utilized to mount the training device 10 to the scope sight 21. The device is then used as described above to overcome target panic.

Figure 4:
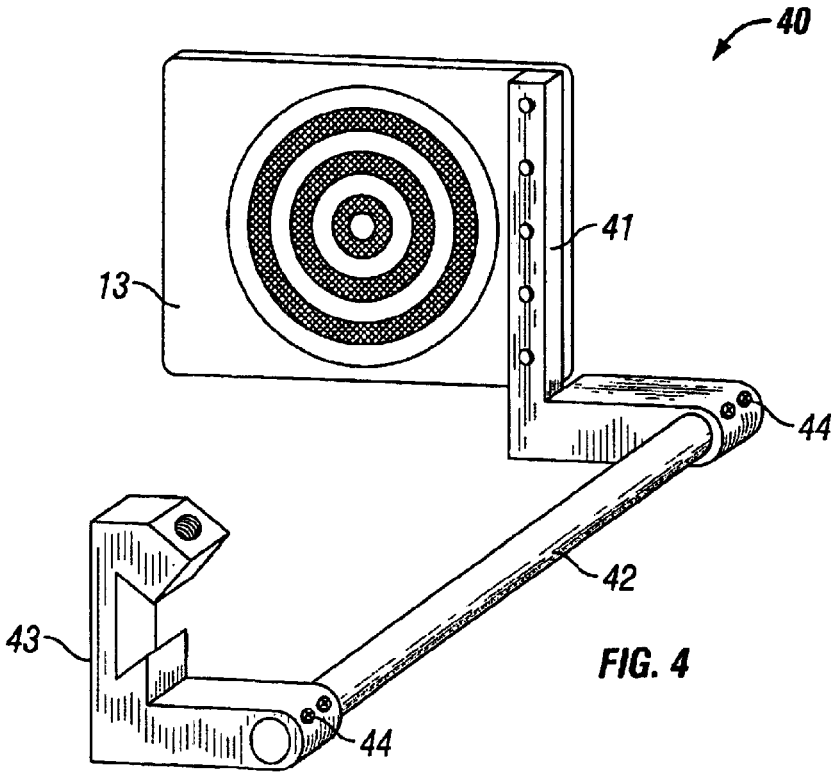
FIG. 4 is a perspective view of a third embodiment of the training device of the present invention illustrating an alternative mechanism for mounting the device on a bow.

FIG. 4 is a perspective view of a third embodiment of the training device 40 of the present invention illustrating an alternative mechanism for mounting the device on a bow. In this embodiment, the device mounts directly to the bow (not shown) rather than to the sight. A picture-mounting bracket 41 is used to mount the picture 13 of the target in the shooter's line of view. The picture-mounting bracket accepts one end of an adjusting rod 42 in an aperture formed in the mount. A bow-mounting bracket 43 attaches to the bow, and accepts the other end of the adjusting rod in an aperture formed in the mount. The position of the picture, may be adjusted by sliding and/or rotating the adjusting rod in the aperture in either the picture-mounting bracket or the bow-mounting bracket. Set screws 44 may be utilized to fix the position of the picture such that it is visually aligned with whatever type of sight the shooter chooses to use. The device is then used as described above to overcome target panic.

Figure 5:
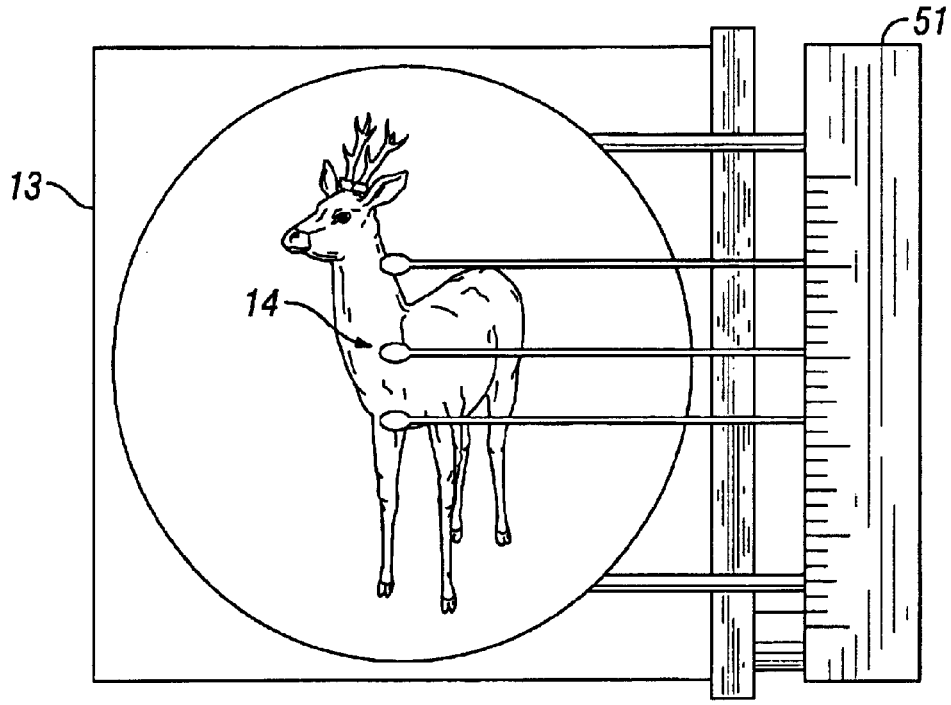
FIG. 5 is an illustrative drawing of a view through an archery pin sight when utilizing the training device of the present invention.

FIG. 5 is an illustrative drawing of a view through an archery pin sight 51 when utilizing the training device of the present invention. The position of the picture 13 has been fixed so that the center pin 14 is held stationary in the center of the picture. With this configuration, the shooter then practices shooting in a safe direction while "aiming" at the pictured target. As noted above, this process trains the subconscious mind to maintain the image that the shooter sees (i.e., the sight pin 14 aligned with the target and not moving). Thereafter, when shooting at an actual target, the mind is conditioned, and the mind will not allow the sight to drift off the actual target when shooting.

Figure 6:
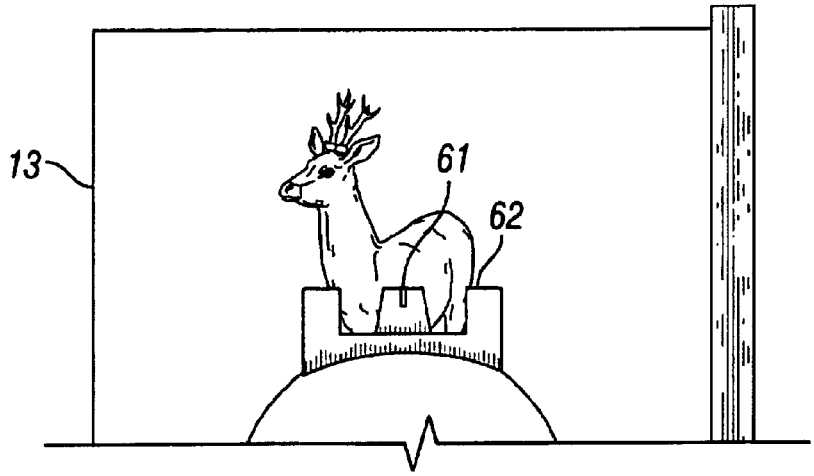
FIG. 6 is an illustrative drawing of a view through a gun sight when utilizing the training device of the present invention.

FIG. 6 is an illustrative drawing of a view through a gun sight when utilizing the training device of the present invention. Although the preferred embodiments are described herein for use in archery training, the present invention is equally applicable to gunnery training. In this configuration, the training device may be mounted on the gun barrel, and the picture may be positioned above the path of any bullet that is fired. Alternatively, the picture may be mounted in front of the gun barrel, and may have a hole in it for the bullet to pass through. As illustrated, the position of the picture has been fixed so that when the front sight 61 is aligned with the rear sight 62, the center of the picture 13 is visually aligned with the gun sight. With this configuration, the shooter then practices shooting in a safe direction while "aiming" at the pictured target. As noted above, this process trains the subconscious mind to maintain the image that the shooter sees (i.e., the gun sight aligned with the target and not moving). Thereafter, when shooting at an actual target, the mind is conditioned, and the mind will not allow the sight to drift off the actual target when shooting.

Figure 7:
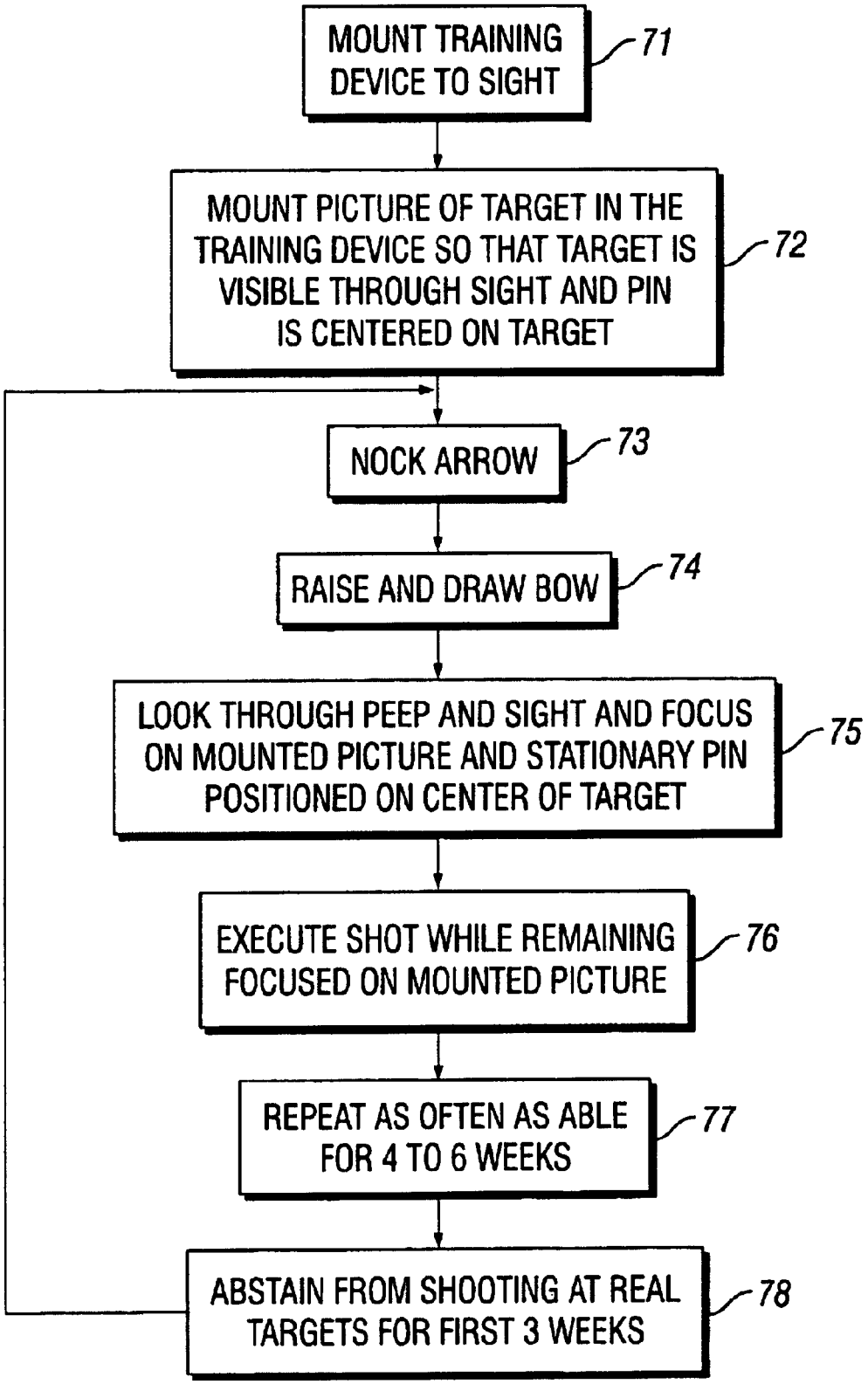
FIG. 7 is a flow chart illustrating the steps of the preferred embodiment of the training method of the present invention.

FIG. 7 is a flow chart illustrating the steps of the preferred embodiment of the training method of the present invention.

The method is described in archery terms, but as noted above, may also be utilized for gunnery training. At step 71, the training device 10 is mounted to the sight, or directly to the bow, depending on the shooting configuration. At step 72, the picture 13 of the target is mounted in the training device so that the target is visible through the sight, and the sighting mechanism (e.g., sight pin, aiming point, etc.) is centered on the target.

The shooter is then ready to practice, and at step 73 loads (nocks) an arrow. At step 74, the shooter raises and draws the bow in a safe direction. For safety reasons, since the shooter cannot actually see where he is aiming, it is recommended that this procedure be performed only at a controlled archery range, and at a distance of no more than five yards from a safe arrow impact zone. At step 75, the shooter then looks through his peep sight and through his pin or scope sight, and focuses on the mounted picture and the stationary sight pin positioned in the center of the target. The shooter then executes the shot at step 76 while remaining focused on the mounted picture of the target.

At step 77, the shooter repeats the training method as often as he is able, and preferably at least once daily, for a training period of four to six weeks. With repetition, this process trains the subconscious mind to maintain this "sight-picture" all the way through the shooting process. It is also recommended at step 78 that the shooter abstain from shooting at real targets and concentrate his training solely on this process for at least the first three weeks of the four to six week training period. Training the subconscious mind takes dedication, requiring many hours of practice and repetition. For those willing to make the effort, test results of the present invention have shown remarkable improvement in shooting accuracy.

It is thus believed that the operation and construction of the present invention will be apparent from the foregoing description. While the training device and method shown and described has been characterized as being preferred, it will be readily apparent that various changes and modifications could be made therein without departing from the scope of the invention as defined in the following claims.

What is claimed is:

1. A training device for training an archer to shoot with improved accuracy, said device comprising:

a picture of a target; and a mounting bracket connected to an archery pin sight, said bracket holding the picture of the target on an opposite side of the pin sight from the archer's eye in a position where a sight pin is visually aligned with the center of the pictured target when the archer is in a hooting position.

2. The training device of claim 1 wherein the mounting bracket connects to archery scope sight and holds the picture of the target in a position where an aiming point in the scope is visually aligned with the center of the pictured target.

3. A training device for training an archer to shoot with improved accuracy, said device comprising:

a picture of a target; and means for mounting the picture on a bow on an opposite side of a sighting mechanism from the archer's eye, said mounting means mounting the picture in a position in which the picture is visually aligned with the sighting mechanism when the archer is in a shooting position.

4. A training device for training a shooter to shoot with improved accuracy, said device comprising:

a picture of a target having an aperture therein that allows a bullet fired from a gun to pass therethrough; and a mounting bracket that connects to a gun barrel and holds the picture of the target in front of the gun, said mounting bracket mounting the picture on an opposite side of a gun sight from the shooter's eye, said mounting bracket mounting the picture in a position in which the center of the picture is visually aligned with the gun sight when the shooter is in a shooting position, and the aperture is aligned with the gun barrel.

5. A method of training a shooter to shoot with improved accuracy, said method comprising the steps of:

fixedly mounting a picture of a target on an opposite side of a sighting mechanism from the shooter's eye, said picture being fixedly mounted in a position in which the center of the picture is visually aligned with the sighting mechanism when the shooter is in a shooting position; and causing the shooter to shoot a plurality of shots while looking through the sighting mechanism at the visually aligned, fixedly mounted picture of the target;

wherein the shooter's subconscious mind is trained to maintain a sight-picture in which the sighting mechanism remains aligned with the target while shooting.

6. The method of training a shooter of claim 5 further comprising repeating the steps of claim 5 at least once daily for a training period of approximately four to six weeks.

7. The method of training a shooter of claim 6 wherein the step of repeating the steps of claim 5 at least once daily for a period of approximately four to six weeks includes abstaining from shooting at real targets for approximately the first three weeks of the training period.

8. A training device for training a gunner to overcome target panic in which the gunner's mind momentarily freezes when firing a gun, and the gunner unconsciously stops making corrections when a sighting mechanism drifts off the target, said device comprising:

a picture of a target; and means for mounting the picture on the gun on an opposite side of the sighting mechanism from the gunner's eye, said mounting means mounting the picture in a position in which the picture is fixedly aligned with the sighting mechanism when the gunner is in a shooting position, wherein the mounting means mounts the picture of the target in a position that does not interfere with a bullet fired from the gun;

wherein the gunner's subconscious mind is trained to maintain a sight-picture in which the sighting mechanism remains aligned with the target while firing the gun.

9. The training device of claim 8, wherein the picture has an aperture therein that allows a bullet fired from the gun to pass therethrough.

10. The training device of claim 8, wherein the mounting means mounts the picture above the path of a bullet fired from the gun.

* * * * *